United States Patent [19]

von Eckardstein

[11] Patent Number: 4,978,073

[45] Date of Patent: Dec. 18, 1990

[54] APPARATUS FOR PNEUMATICALLY DISCHARGING LIQUIFIED BUILDING MATERIAL CONTAINING A HARDENER

[75] Inventor: Karl-Ernst von Eckardstein, Unna, Fed. Rep. of Germany

[73] Assignee: Friedrich Wilh. Schwing GmbH, Herne, Fed. Rep. of Germany

[21] Appl. No.: 273,131

[22] Filed: Nov. 14, 1988

Related U.S. Application Data

[63] Continuation-in-part of Ser. No. 190,769, May 6, 1988, abandoned, which is a continuation of Ser. No. 879,095, Jun. 26, 1986, abandoned.

[30] Foreign Application Priority Data

Jun. 28, 1985 [DE] Fed. Rep. of Germany ..... 35231432

[51] Int. Cl.[5] ..... B05B 7/04

[52] U.S. Cl. ..... 239/419.3; 239/427.5; 239/432; 239/588

[58] Field of Search ..... 239/8, 9, 77, 195, 226, 239/427, 434, 430, 431, 588, 654, 336, 433, 369, 371, 427.5, 428, 545, 419.3; 366/3, 10, 21; 406/153, 196

[56] References Cited

U.S. PATENT DOCUMENTS

| | | | |
|---|---|---|---|
| 2,392,408 | 1/1946 | Radovich | 239/431 X |
| 2,543,517 | 2/1951 | Anderson | 366/11 X |
| 3,226,036 | 12/1965 | Brahn | 239/428 X |
| 3,478,963 | 11/1969 | Winn | 239/428 X |
| 3,871,583 | 3/1975 | Kellert | 239/302 |
| 4,050,677 | 9/1977 | Benthin | 366/11 |
| 4,239,397 | 12/1980 | Zandell et al. | 366/11 X |
| 4,289,732 | 9/1981 | Bauer et al. | 239/545 X |
| 4,421,797 | 12/1983 | Kochne | 239/427.5 X |

*Primary Examiner*—Andres Kashnikow
*Assistant Examiner*—Kevin P. Weldon
*Attorney, Agent, or Firm*—Price, Heneveld, Cooper, DeWitt & Litton

[57] ABSTRACT

An apparatus for pneumatically discharging a liquified building material includes a first source of liquid hardener and injection means for injecting the liquid hardener perpendicularly into the air-entrained building material at the discharge nozzle. The liquid hardener may be supplied through an atomizer and injected through openings that are enlarged. A second source of liquid hardener may be provided to supply a second hardener mixed with the airstream that entrains the building material. A flexible tubing may be provided between the aeration fitting and discharge nozzle to require that only the discharge nozzle be lifted by the operator.

5 Claims, 3 Drawing Sheets

APPARATUS FOR PNEUMATICALLY DISCHARGING LIQUIFIED BUILDING MATERIAL CONTAINING A HARDENER

This is a continuation-in-part of copending application Ser. No. 07/190,769, filed on May 6, 1988, which is a continuation of application Ser. No. 06/879,095 filed June 26, 1986, now abandoned.

FIELD OF THE INVENTION

The present invention relates to an apparatus for pneumatically discharging a liquified building material such as concrete or mortar, and in particular to such an apparatus including means for adding liquid actuator or hardener to the building material prior to discharging.

BACKGROUND OF THE INVENTION

The hardened building materials discharged by the inventive apparatus serve, in general terms, to line or form parts of a structure. The invention is therefore applicable not only to sprayed or air-applied concrete or mortar but also to other building materials with different compositions. These include, for instance, the sprayable plasters. Pneumatically applied hydraulic building materials are also used below ground, i.e., in mining and tunnel construction. The substances used here often range from grainy to powdery and have different water-to-solids ratios. When being sprayed these substances are often handled with aggregates consisting of synthetic material or fiber mixtures, for example.

The invention is applicable, for instance, to air-applied concretes or mortars made of these building materials, which are in turn applied several centimeters thick, to the stone linings of underground tunnels. The invention is especially useful in applying such building materials to sloping vertical and overhead ceiling surfaces of underground tunnels, as soon as these surfaces are formed by blasting, or the like, in order to increase the inherent bearing strength of the surrounding ground. The inventive apparatus is also used for sealing fire dams and ventilation dams and applying the finish surface on walls to increase their weathering resistance, and in general for lining application. For the purpose of obtaining early strength, liquid activator is mixed into the building material to activate it to harden and thereby ensure optimum bearing strength in as short a time as possible which, in underground working, for instance, keeps the contraction of the strata low. The activator is often water glass, which accelerates the hardening process at varying rates depending on the dose.

Compared with the likewise known methods of dry conveyance, in which the necessary mixing water and activator are added to the dry building material at the discharge end of the gunning apparatus, the hydromechanical conveyance of the wet building material, in particular in the form of mortar or concrete, involves the advantage that the applied layers have an even composition in accordance with a given recipe, which avoids the fluctuations in strength in the applied layers resulting from uneven compositions of the building material and controlled addition of water.

In the conventional hydromechanically conveyed, pneumatically discharged application process, the building material is combined with water in a batch process remote from the spraying apparatus and conveyed to the apparatus through a conveyor line under the power of a positive displacement pump or the like. The building material is discharged with the aid of a discharge pipe, preferably provided with a nozzle, connected to the conveyor pipe through which the liquified mixture is conveyed. The surface to be coated is sprayed, being provided with a coat or a backfill by directing the flexible conveyor line portion. This directing is generally performed by an operator by hand.

In one variation of this process, the building material is put in suspension and accelerated with the aid of the compressed air added via nozzles. If an activator or hardener is to be added, it must be done in such a way that the building material begins to harden only when the building material has been discharged and has reached the surface of the structure. It is therefore favorable to add the activator to the building material at the discharge end of the gunning apparatus, if possible. However, this often means that the activator does not mix completely and homogeneously with the building material As a result, the layer created on the surface in question by direction of a flexible portion for the conveyer line, turns out to be non-homogeneous and the early strength is thus not obtained uniformly. An additional problem of adding the activator at the discharge end of the gunning apparatus is the possibility that the activator liquid may not completely combine with the building material and be discharged to the atmosphere with the delivery air which leads to undesirable pollutant concentrations in the atmosphere.

This incomplete combination of the activator and the building material may also lead to rebounding losses, this term referring to the percentage of discharged building material which does not stick to the surface of the structure and falls off. It is true that the ranges of 30 to 40% ascertained for dry methods in underground working are not experienced by the wet methods to which the invention relates. However, there are many factors that influence rebounding losses. It depends, for instance, on the adhesive power of the building material, the angle of impact of the stream of building material discharged from the discharge opening, and similar parameters. In particular, systematic changes in the bearing strength of the base hit by the building material being sprayed constitutes one of the essential causes for rebounding. Regardless of the hardness of the impact, for example on a rock surface, the resistance of the base changes as the sprayed layer builds up, and is generally smaller the more the coat grows. The early strength of the building material therefore plays a part in this connection, as does the amount of building material discharged in a particular case. Rebounding losses can be limited to a large extent, in particular on overhangs, by providing a complete and homogeneous mixture of a hardener or activator with the building material discharged by the apparatus.

SUMMARY OF THE INVENTION

The point of departure for the invention is a known apparatus disclosed in U.S. Pat. No. 4,708,288 issued to the present inventor for A METHOD AND APPARATUS FOR PNEUMATICALLY DISCHARGING HYDROMECHANICALLY CONVEYED HYDRAULIC BUILDING MATERIAL FOR UNDERGROUND OPERATIONS. The present invention provides an enhancement to such apparatus by including injection means in the discharge nozzle of the spraying apparatus for introducing liquid hardener perpendicularly into the pneumatically discharged hydraulic building material. The perpendicular injection of liquid hardener into the mix passing through the nozzle causes a deep penetration of particles of hardener into the building material for a more thorough combination and resulting homogeneous mixture. The tendency for the hardener to be discharged from the nozzle, present in prior art devices, is greatly reduced because the hardener is not directed towards the nozzle outlet. Therefore, the difficulties of using quick-acting hardeners, which must be added to the building material in the region of the discharge nozzle, are substantially overcome.

According to one aspect of the invention the liquid hardener is introduced into the injection means in the form of a fine dispersement of liquid particles in an airstream. The dispersement is provided by a source of liquid hardener and atomizing means for atomizing the liquid hardener by compressed air, and is conveyed to the injection means by conveying means. The resulting fine dispersement of the liquid hardener in an airstream increases the probability that each hardener particle will encounter a particle of building material This increases the effectiveness of the liquid hardener and the strength of the resulting building structure while reducing the amount of hardener required to assure adequate saturation of the building material.

According to another aspect of the invention, the liquid hardener atomizing means includes a restricted portion of the compressed air conduit, means for discharging liquid hardener into the restricted portion to atomize the liquid hardener into the airstream and a downstream expanded portion adjacent the restricted portion. This structure causes the airstream containing the liquid hardener particles to expand in volume, which reduces the tendency of the liquid hardener particles to recombine into larger particles and droplets by the time that the mixture is injected into the nozzle. In this manner, the apparatus provides a more fine and even dispersement of liquid hardener particles for injection into the mix passing through the nozzle.

According to yet another aspect of the invention, the conveying means is constructed in a manner to avoid substantial restriction of the passage between the expanded portion of the atomizing means and the discharge nozzle to reduce the tendency of the finely dispersed particles of liquid hardener to recombine into larger particles and droplets prior to dispersement in the building material. This is accomplished in part by providing a plurality of tubes extending to the injection means and having combined cross-sectional areas substantially equal to the cross-sectional area of the expanded portion of the atomizing means. Additionally, the injection means comprises a plurality of openings extending through the nozzle wall, with each opening connected to one of the conveying tubes and having a cross-sectional area equal to that of the associated conveying tube. It has been discovered that, in this manner, not only is there a reduction in the tendency of the liquid hardener particles to recombine into larger particles, but the openings themselves are less prone to fouling by a mixture of building material and liquid hardener. As a result, the apparatus is capable of continuous operation for a substantially longer period of time before it must be disassembled for cleaning. Further, the larger openings in this preferred form of the invention are easier to clean of any buildup of hardened building material.

According to yet another aspect of the invention, the discharge nozzle and injection means are joined with the aeration fitting by a flexible hose portion. This construction allows the entire conveyor line portion loaded with the weight of the dense stream, and the aeration fitting joined thereto to be positioned, for example, on the ground or floor of the structure. The discharge nozzle and the flexible portion of hose, joined to the aeration fitting, are lighter than the part positioned on the floor and therefore much easier to maneuver. The hose also has considerably less weight because, in this portion, the dense stream of hydraulic building material has already been converted into a suspension of the building material in the stream of compressed air, and, therefore, the concentration of the heavy building material is much lower than in the dense stream. Consequently, the operator only needs to lift a much smaller weight and does not have to bear any reaction force except for that occurring at the discharge nozzle and the small force occurring at the opening of the hardener line. On the other hand, the invention avoids the difficulties described above in connection with the improper selection of the location where the hardener is added, by providing for injection of liquid hardener in the nozzle immediately before the end discharge opening.

These and other related objects, advantages and features of this invention will become apparent upon review of the following specification in conjunction with the drawings.

DESCRIPTION OF THE PREFERRED EMBODIMENT

Figure 1:
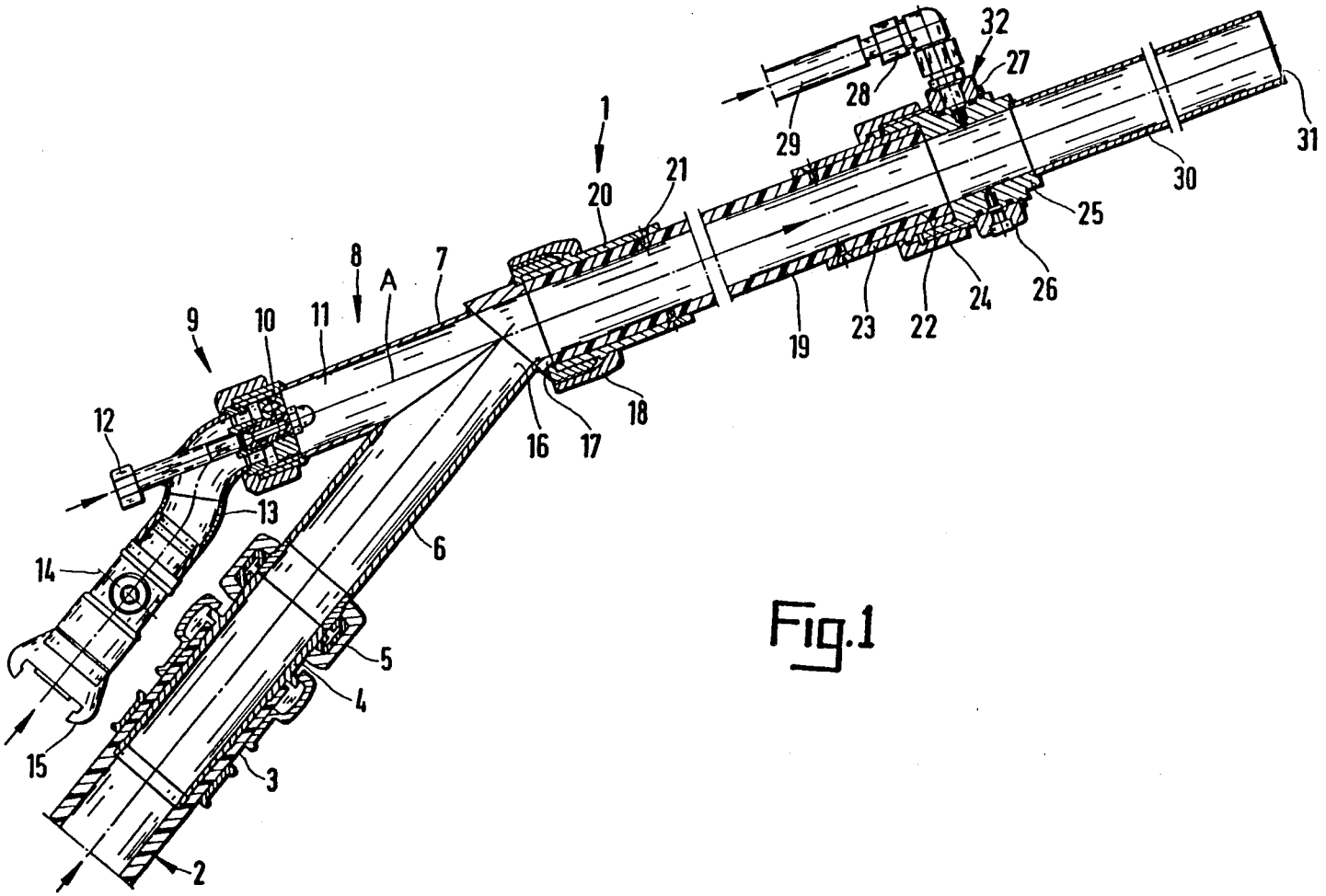
FIG. 1 is a central section view of an apparatus embodying this invention omitting all details not required for understanding the invention.

The apparatus referred to in general by the numeral 1, in FIG. 1, serves the purpose of pneumatically discharging a building material, i.e., pneumatically dispensed concrete, supplied hydromechanically in a dense stream by a conveyor line 2. The last portion of this conveyor line 2 is formed as a hose 3 into which a connector or joining pipe 4 is integrally joined. With the aid of a coupler 5, joining pipe 4 is connected to a pipe socket 6 which leads at an acute angle into a conveyor pipe 7 of an aeration fitting, referred to in general as 8. Outer end 9 of conveyor pipe 7 mounts a nozzle insert 10, whose nozzle 11 is concentric with axis A of conveyor pipe 7. Nozzle insert 10 forms the end of a feed pipe 12 which supplies a first liquid activator or hardener.

Feed pipe 12 penetrates an S-shaped end pipe 13. Connected to pipe 13 is a stopcock 14 which is provided with a C-coupler 15 for a hose (not shown) through which compressed air can be introduced into pipe 7 through nozzle insert 10 when cock 14 is open.

The inner end 16 of pipe socket 6 is merged with pipe 7 between outer end 9 and an inner end 17 of pipe 7. End 17 is connected to an end of a directing hose 19 by a union nut 18. The union nut engages a protective pipe sleeve 20 mounted on directing hose 19 with the aid of a plurality of radially disposed screws 21.

An opposite, maneuverable end 22 of directing hose 19 is in turn provided with a protective pipe sleeve 23 to which is joined a union nut 24. The union nut in turn connects a pipe joint 25 to sleeve 23. A plurality of nozzles 26 are mounted on the periphery of pipe joint 25 and spaced at 45° intervals around said joint. The nozzles are each supplied with a second activator or hardener from a second source of liquid hardener (not shown), through a hose line 29, a nipple 27 and an elbow 28. Nozzles 26 are mounted perpendicular to axis A and provide injection means, generally shown at 32, for injecting a second liquid activator perpendicularly into hose 19 with respect to the direction of material flow through hose 19. Connected to the free end of joint 25 is a short pipe 30 which may have a nozzle-shaped design, i.e. taper toward the free discharging end 31.

In operation, the entire part of the described apparatus up to the union nut 18 is positioned on the ground or on the floor of a structure or mounted on a mast, for example, which bears a working platform or a cage on which the operator stands. The operator picks up only the front part of the apparatus, i.e. pipe 30, which is flexibly connected to the ground or floor supported part of the apparatus by directing hose 19. The operator aims discharge opening 31 at the structure surface to be coated with applied concrete and guides opening 31 in a manner that causes the building material to be deposited evenly and in accordance with the formation of a desired layer thickness.

To prepare the apparatus for operation, conveyor line 2 is serviced by a concrete pump capable of positively displacing the liquified building material and compressed air is provided from a stationary compressed air line by supply pipe 13 upon opening of cock 14. Feed pipe 12, for the first activator, is connected to a supply tank for the first activator, and hose 29 is connected to a second supply tank for the second activator. Both tanks are connected to a high-pressure pump for feeding the activators to apparatus 1.

The stream of compressed air discharged behind insert 10 is fed with the first activator by nozzle 11, the liquid activator being broken up into fine drops which are distributed in the stream of compressed air. At opening 16 of pipe 6 the stream of compressed air breaks up the dense stream of building material fed from line 2. This causes the particles of hydrated building material supplied by the hydromechanical conveyor to be suspended in the stream of compressed air and liquid activator particles. This suspension is conveyed through directing hose 19 where the second liquid activator is injected perpendicularly by injection means 32 into the mix to thoroughly disperse the second liquid activator within the building material already containing a homogeneous dispersement of the first liquid activator. This second activator leads to a rapid hardening of the building material, which is discharged directly through nozzle pipe 30 and discharge opening 31.

Figure 2:
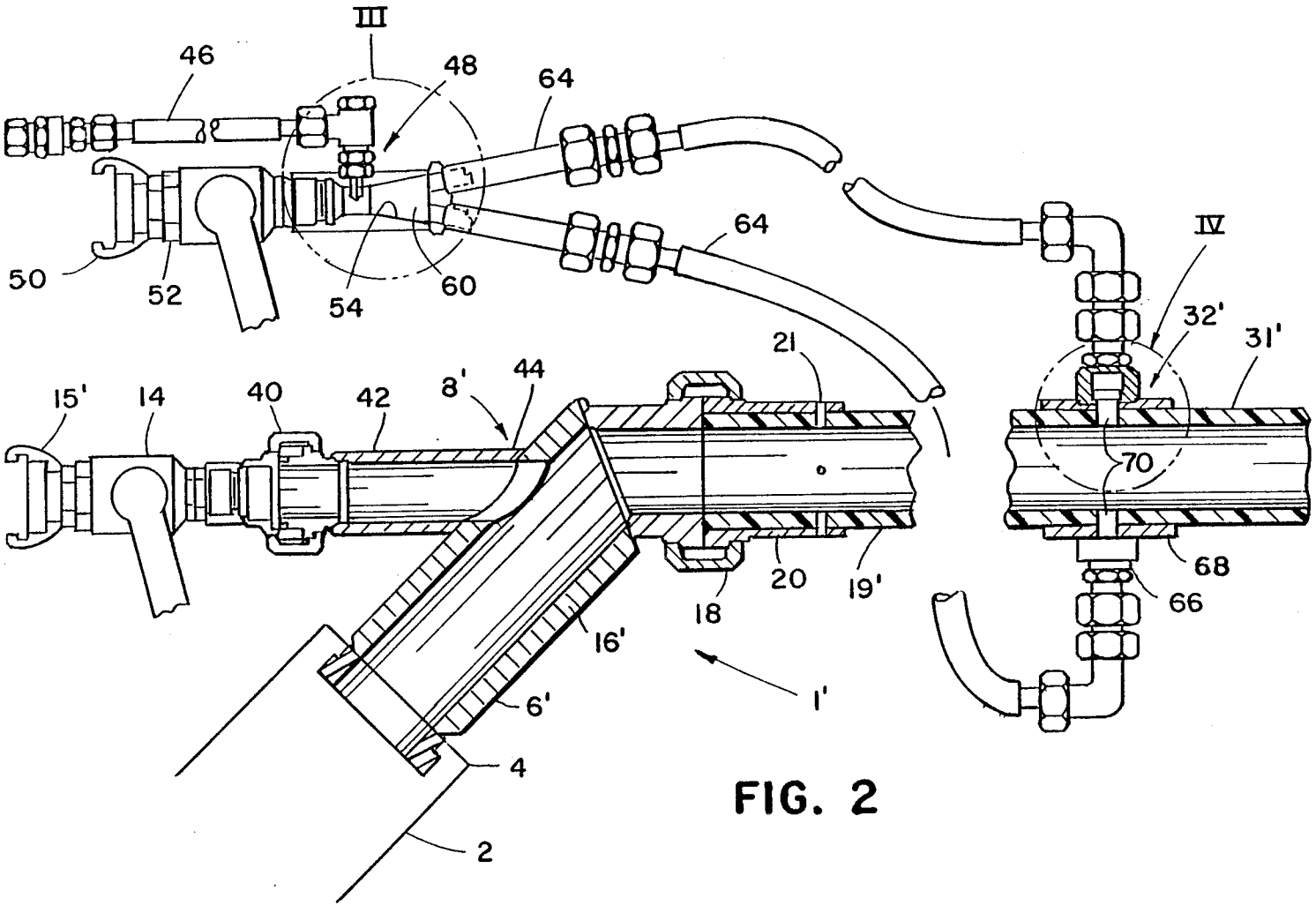
FIG. 2 is a central section view of an alternative embodiment of an apparatus embodying this invention.
Figure 3:
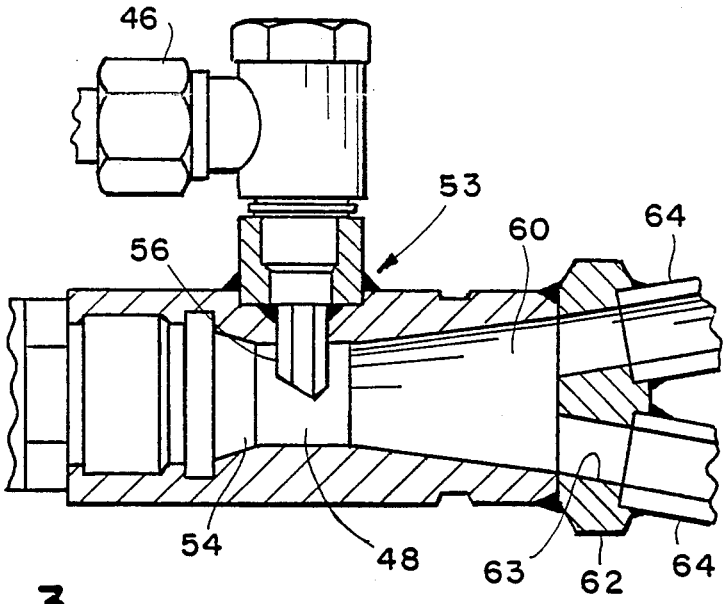
FIG. 3 is an enlarged section view of the area indicated at III in FIG. 2.
Figure 4:
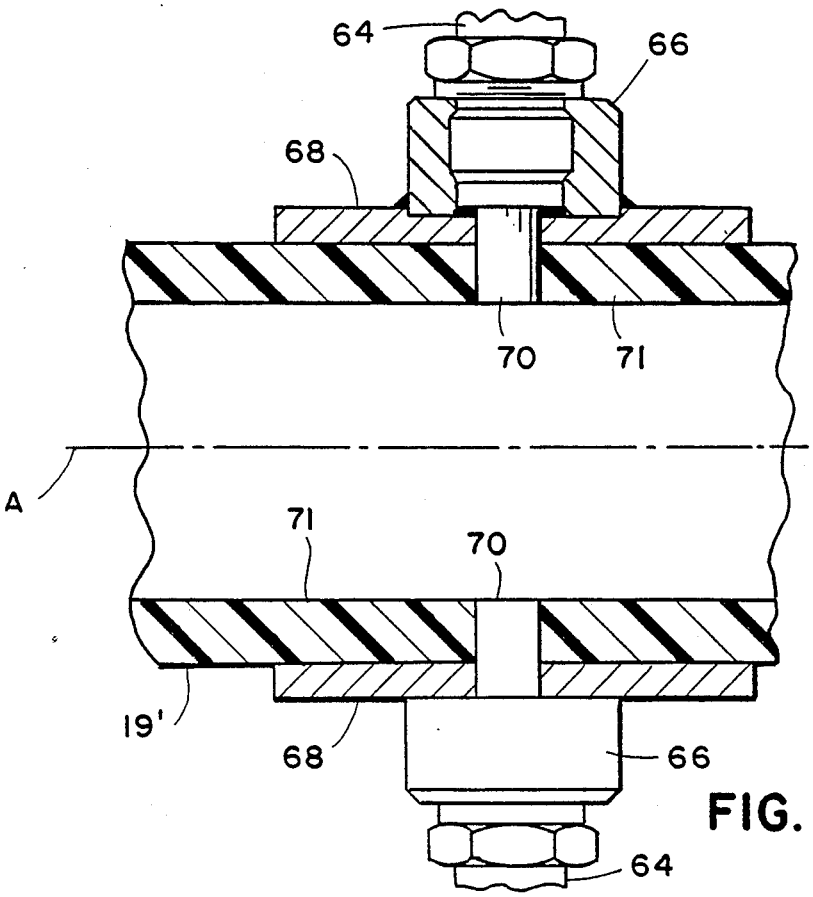
FIG. 4 is an enlarged section view of the area indicated at IV in FIG. 2.

In a second version of the apparatus, shown as 1′ in FIGS. 2–4, conveyor line 2 is connected by a connector 4 to pipe socket 6′. A C-coupler 15′ for connection to a source of compressed air is connected through stop cock 14 and a coupler 40 to a compressed air conduit 42. Compressed air conduit 42 includes an inner end 44 which penetrates the inner opening 16′ of pipe socket 6′ at an acute angle. Compressed air conduit 42 is generally in line or coaxial with directing hose 19′. The aeration fitting 8′ is connected to hose 19′ by a protective pipe sleeve 20 and coupling 18. Flexible directing hose 19′ extends from pipe sleeve 20 to an opposite discharge end 31′ in a slightly tapered fashion to provide a discharge nozzle.

Injection means 32′ are provided adjacent discharge end 31′ and provide means for injecting a liquid activator or hardener perpendicularly into hose 19′ with respect to the direction of air-entrained building material flowing through the hose. The liquid activator is supplied from a source of liquid activator, such as a high pressure pump connected to a hardener storage tank (not shown) by a liquid activator line 46 to a liquid activator atomizer 48. A C-coupling 50 for connection to a source of compressed air is connected by a compressed air conduit through stop cock 52 to a chamber 54 into which a liquid hardener discharging orifice 56 extends from line 46 (FIG. 3).

Chamber 54 includes a throat of restricted portion 48 having a cross-sectional area smaller than the adjacent upstream portion of the compressed air conduit and into which orifice 56 extends, thus effecting a venturi into which the source of liquid hardener extends. Chamber 54 further has an expanded portion 60 having a cross-sectional area substantially greater than that of restricted portion 48 and located adjacent to and downstream of the restricted portion. A hose coupling 62 is attached adjacent expanded portion 60 and includes a plurality of openings 63 extending therethrough. The size of openings 63 is preselected such that the sum of their cross-sectional areas is substantially equal to the cross-sectional area of expanded portion 60. A plurality of hoses 64 having the same cross-sectional area as the openings 63 are connected to hose openings 63 of coupling 62.

Each hose 64 is, in turn, connected to a hose coupling 66 attached to sleeve 68 surrounding directing hose 19′. The interior of each hose 64 is pneumatically connected with a discharge opening 70 extending through sleeve 68 and wall 71 of hose 19′ in a direction that is perpendicular to the central axis A of hose 19′ along which the air-entrained building material flows Discharge openings 70 have a cross-sectional area preselected to be substantially equal to that of the respective hose 64. Openings 70 in this embodiment are substantially larger than the nozzles 26 in the FIG. 1 embodiment.

To prepare apparatus 1′ for operation, liquid activator line 46 is connected to a supply tank for liquid activator which is provided with a high-pressure pump (not shown) for feeding liquid activator to line 46. C-coupling 50 is connected to a source of compressed air. With stop cock 52 opened, compressed air passes through chamber 54 past discharging orifice 56. Liquid activator is discharged into the stream of compressed air as a fine dispersement of liquid particles as the stream passes through restricted portion 48. Restricted portion 48 causes the air flow to increase in velocity and pressure. As the mixture of air and liquid hardener particles enters expanded portion 60, the resulting increase in volume and reduction of pressure reduces the tendency of the finely dispersed particles of liquid hardener to recombine as droplets in the airstream. Because the combined cross-sectional area of hoses 64 and discharge openings 70 are substantially equal to that of expanded portion 60, there is no substantial increase in pressure of the air and liquid hardener particle stream as it is injected into the pneumatically conveyed building material in hose 19′. Thus, the liquid hardener particles remain finely dispersed in the airstream to provide a more effective and efficient combination with the particles of building material passing through hose 19'. Furthermore, it has been discovered that the relatively large size of discharge openings 70 is effective in reducing the tendency of these openings to foul in response to the addition of quick-acting activators or hardeners into the building material in the vicinity of openings 70.

The apparatus 1' is illustrated in FIGS. 2 through 4 as having one source of liquid activator injected adjacent the discharge nozzle portion of the apparatus. However, it is advantageous to combine the first liquid activator nozzle 11 from FIG. 1 with the apparatus 1' in FIG. 2 to provide two sources of liquid activator. In such combination, the nozzle 11 may introduce the first portion of a two-part activator system with the second part added by injecting means 32 adjacent the discharge nozzle. Alternatively, a slow-acting activator may be added by nozzle 11 to combine with the building material during the dwell time of the building material in the apparatus 1 and a quick-acting hardener provided by injecting means 32 to quickly set up the discharged building material.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A manually maneuverable means of discharging air-entrained liquified building material containing a hardener comprising:

an aeration fitting having a first conduit connected to a source of building material in liquified flowable condition an d a second conduit having an inlet end connected to a source of compressed air and a discharge end and into which between said ends said first conduit merges;

a discharge nozzle for the mixture of air and entrained building material spaced from the merger of said first and second conduits;

a source of liquid hardener;

injection means in said nozzle for introducing liquid hardener from said source of liquid hardener perpendicularly into the mix passing through a wall of said nozzle;

said source of liquid hardener including a compressed air conduit connected to a source of compressed air, liquid hardener atomizing means connected to said liquid hardener source and said compressed air conduit for atomizing liquid hardener by compressed air and conveying means for conveying a dispersion of fine particles of liquid hardener in air from said atomizing means to said injection means; and said liquid hardener atomizing means including a chamber having a restricted portion downstream said compressed air conduit, discharging means for discharging liquid hardener into said restricted portion and an expanded portion adjacent to and downstream of said restricted portion, said expanded portion having a cross-sectional area that is substantially larger than that of said restricted portion.

2. A manually maneuverable means of discharging air-entrained liquified building material containing a hardener as described in claim 1 in which said conveying means comprises a plurality of tubes having combined cross-sectional areas substantially greater than the cross-sectional area of said restricted portion.

3. A manually maneuverable means of discharging air-entrained liquified building material containing a hardener as described in claim 2 in which said injection means comprises a plurality of openings extending through a wall of said nozzle perpendicular to the direction of mix passing through the nozzle, each of said openings connected to one of said tubes and having a cross-sectional area not substantially less than the cross-sectional area of the associated tube.

4. A manually maneuverable means of discharging air-entrained liquified building material containing a hardener as described in claim 3 in which said plurality of inlet openings are arranged at equal spacing around said discharge nozzle.

5. Manually maneuverable means of discharging air-entrained liquified building material comprising:

a conduit and means providing through said conduit a source of air-entrained liquified building material under pressure, a portion of said conduit adjacent its discharge nozzle being flexible;

an atomization chamber, a source of compressed air connected to said chamber for establishing a stream of air through said chamber, a source of liquid hardener opening transverse said stream of air into said chamber through discharge means for discharging a fine dispersement of liquid hardener into said stream of air;

said chamber including a throat of restricted cross section effecting a venturi, said source of liquid hardener opening into said throat, the downstream end of said chamber having a pair of discharge ports, each of said ports being connected to only one of said hardener introduction openings, said discharge ports having combined cross-sectional areas greater than the cross-sectional area of said throat; and a pair of oppositely directed hardener introduction openings mounted on said nozzle adjacent its discharge end, flexible conduit means connecting the discharge end of said chamber to both of said openings for introducing atomized hardener into the building material adjacent the discharge end of the flexible nozzle.

* * * * *